US005195484A

United States Patent [19]

Knapp

[11] Patent Number: 5,195,484

[45] Date of Patent: Mar. 23, 1993

[54] AIR CLEANER AND SNORKEL ASSEMBLY

[75] Inventor: Fritz J. Knapp, Lansing, Mich.

[73] Assignee: General Motors Corporation, Detroit, Mich.

[21] Appl. No.: 781,305

[22] Filed: Oct. 24, 1991

[51] Int. Cl.[5] ..... F02B 77/00

[52] U.S. Cl. ..... 123/198 E; 55/419; 180/68.3

[58] Field of Search ..... 123/198 E; 55/419; 180/68.3, 69.25

[56] References Cited

U.S. PATENT DOCUMENTS

| | | | |
|---|---|---|---|
| 1,086,763 | 2/1914 | Goersch | 55/347 |
| 2,936,853 | 5/1960 | Heller et al. | 55/419 |
| 2,943,699 | 7/1960 | Thornburgh | 55/276 |
| 3,413,780 | 12/1968 | Almott et al. | 55/276 |
| 3,444,671 | 5/1969 | Florine | 55/267 |
| 3,452,521 | 7/1969 | Remacle | 55/419 |
| 3,877,908 | 4/1975 | Phelps et al. | 55/419 |
| 4,735,640 | 4/1988 | Thornburgh et al. | 55/315 |
| 4,846,860 | 7/1989 | Yu | 55/337 |
| 4,860,703 | 8/1989 | Boda et al. | 123/195 P |

FOREIGN PATENT DOCUMENTS

| | | | |
|---|---|---|---|
| 1493497 | 7/1989 | U.S.S.R. | 180/68.3 |

OTHER PUBLICATIONS

Motorcyclist, pp. 23, 24, Apr. 1990.

*Primary Examiner*—Noah P. Kamen
*Attorney, Agent, or Firm*—Robert J. Outland

[57] ABSTRACT

An engine air intake system comprises a primary inlet tube or snorkel with an opening that provides air to the air cleaner, and a secondary inlet opening located downstream from the primary inlet opening. The primary inlet tube also has a low point, with a drain to eliminate any of the water. If the primary inlet tube becomes partially or completely blocked with water, the secondary inlet tube will provide the necessary air to the engine until the water is eliminated through the drain.

2 Claims, 2 Drawing Sheets

AIR CLEANER AND SNORKEL ASSEMBLY

TECHNICAL FIELD

This invention relates to a continual source of air for the engine air intake system when the primary source is partially or completely blocked by water.

SUMMARY OF THE INVENTION

During vehicle operation, the engine needs a constant supply of fresh air for the combustion process. Therefore, the air inlet to the air cleaner is usually located near an opening to the exterior of the vehicle. Because of this location, the air inlet is susceptible to water. If the amount of water is significant, the air inlet can be blocked and inhibit air flow to the air cleaner. This can cause the vehicle to stumble or stall. If the engine vacuum is high enough, the water may be sucked into the engine. As a result, the engine can be damaged.

This invention prevents water ingestion into the engine by providing a sump in the fresh air inlet tube, a drain at the low point of the sump, and a vent or small secondary inlet downstream from the sump. If the air inlet is blocked with water, the secondary inlet will provide adequate air for the engine to function. The secondary inlet will also reduce the vacuum pressure upon the water in the primary inlet, thereby reducing the chance for water ingestion in the engine. The sump will hold the water until it can be eliminated through the drain.

The details as well as other features and advantages of two embodiments of this invention are set forth in the remainder of the specification and are shown in the drawings.

THE PREFERRED EMBODIMENTS

Figure 1:
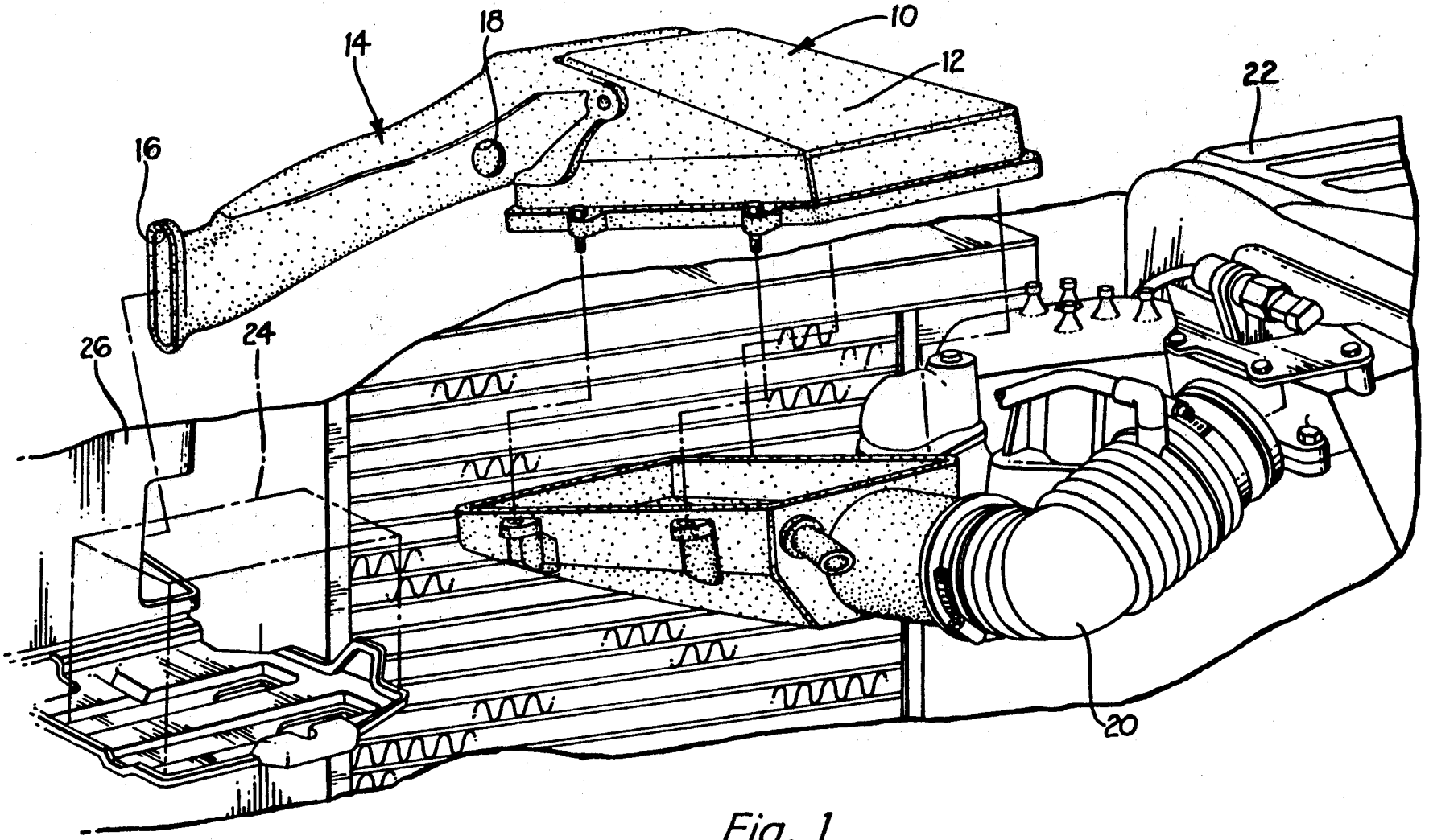
FIG. 1 is a schematic view of the engine air intake system employing a first embodiment of this invention.

Referring first to FIG. 1, an engine air intake system is shown in an engine compartment. An air cleaner 10 is a conventional type having a housing 12 which encloses a filter element (not shown). A snorkel 14 is snap fitted or bolted to the air cleaner 10. The snorkel 14 comprises a primary air inlet 16 and a secondary air inlet 18. Fresh air enters the primary air inlet 16 and travels through the snorkel 14 before being introduced to the air cleaner 10. The secondary air inlet 18 is downstream from the primary air inlet 16 and is located in a dry area of the engine compartment, close to the air cleaner housing 12. The snorkel 14 is on an inclined plane, with the primary air inlet 16 at a lower level than the secondary air inlet 18, so that the air travels through the snorkel 14 uphill to get to the air cleaner 10. Any water that might splash into the air intake system will then normally drain out of the primary air inlet 16 by the force of gravity. If the amount of water temporarily blocks the primary air inlet 16, air can enter the snorkel 14 through the secondary air inlet 18. The air will then enter the air cleaner housing 12 to be filtered. The air exits the air cleaner 10 by way of the clean air duct 20 to enter into the engine 22.

The area of the secondary air inlet 18 is determined so that when the primary air inlet 16 is open, the amount of air entering the secondary air inlet 18 is less significant compared to the amount of air entering the primary air inlet 16. But the area of the secondary air inlet 18 should be large enough to offset the vacuum force upon any water that blocks the primary air inlet 16 so that the water will not be ingested into the engine 22. To increase the performance of the engine, it is advantageous to provide cool air through the air intake system. Since the primary air inlet 16 is closer to the front of the engine compartment, it has access to cool ambient air. The secondary air inlet 18 is located further into the interior of the engine compartment where the air is warmer. By keeping the area of the primary air inlet 16 larger than the area of the secondary air inlet 18, a larger volume of cool air will be sucked into the engine through the primary air inlet 16.

In the first embodiment, the secondary air inlet 18 is a 43 mm. diameter hole drilled into the rear side of the snorkel 14. To maximize the air flow and minimize the susceptibility to water ingestion, the primary air inlet 16 is located in the front of the engine compartment between the front frame (not shown) and battery 24. A panel 26 surrounds the primary air inlet 16 and isolates it from water splash that may enter the main engine compartment.

Figure 3:
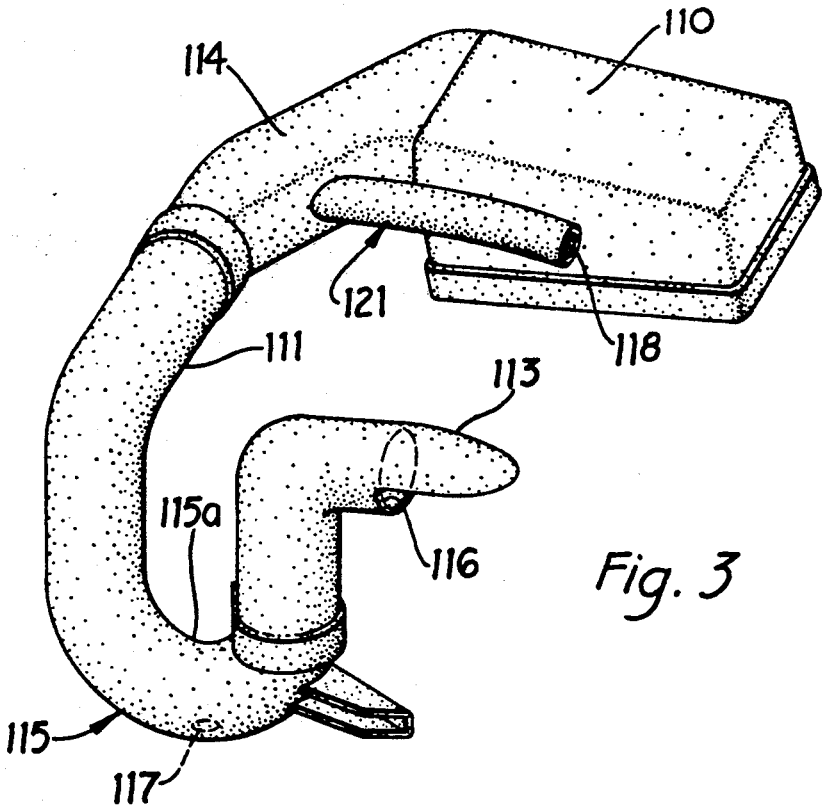
FIG. 3 is an isolated view of the air inlet for FIG. 2.
Figure 2:
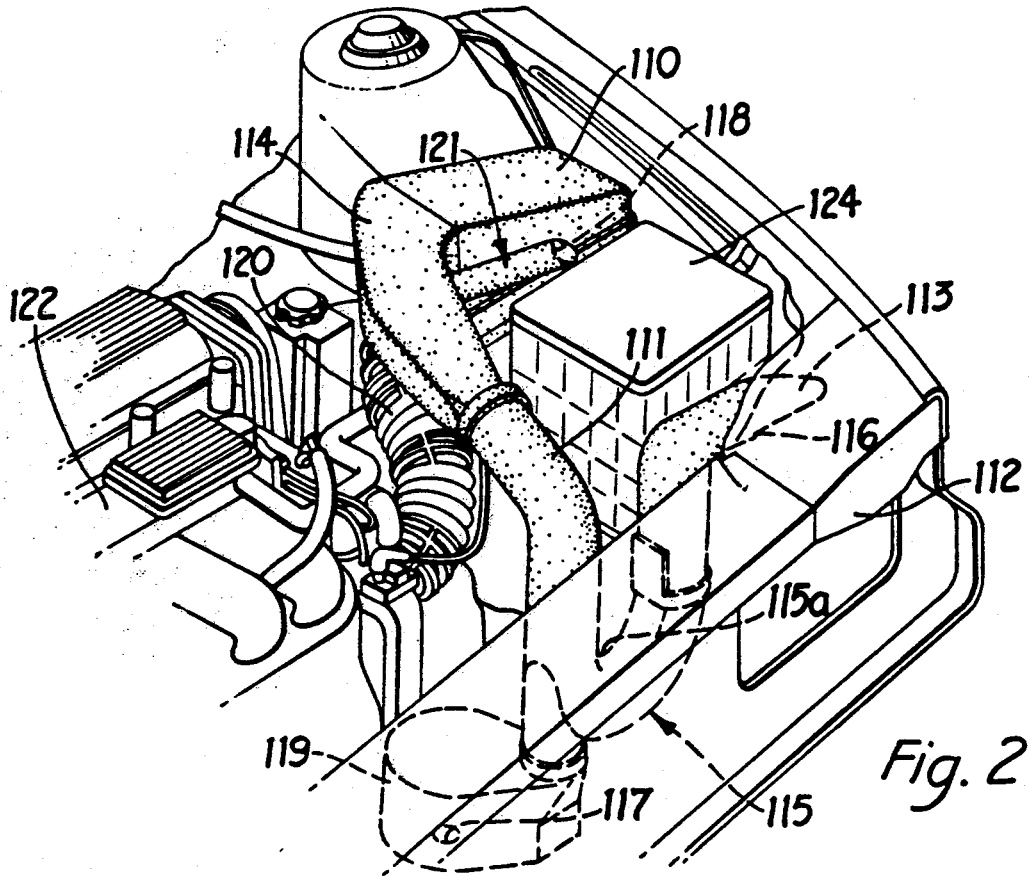
FIG. 2 is a schematic view of the engine air intake system employing the second embodiment of this invention.

FIG. 2 shows the second embodiment in its location in the engine compartment; and FIG. 3 shows the second embodiment isolated from the engine compartment to distinguish more clearly the components. A primary air inlet 116 is located in the front of the engine compartment, between a battery 124 and the front frame 112 of the vehicle. The primary air inlet 116 faces the side of the vehicle. This location protects the primary air inlet 116 from frontal water splash and also provides access to cool outside air. The primary air inlet 116 is further protected from water intrusion by a hood 113 over the primary air inlet 116. The hood 113 is an extension of an air tube 111 over the top of the primary air inlet 116. The primary air inlet 116 introduces the air to the air cleaner 110 by means of the air tube 111 and a snorkel 114 which are snap fitted or molded together. The mid section of the air tube 111 is molded to form a sump 115. The sump 115 acts as a trap to hold any water that may enter the primary air inlet 116. At the bottom of the sump 115 is a drain 117 to eliminate the water The size of the drain 117 is approximately 3 mm. diameter A resonator 119 may be positioned beneath the sump 115 with an extension from the air tube 111 to communicate with the sump 115. The resonator 119 will increase the volume of the sump 115, although the primary purpose of the resonator 119 is a noise silencer If a resonator 119 is used, the drain 117 will be located at its bottom.

Downstream from the primary air inlet 116 and located close to the air cleaner 110 is a secondary air inlet 118. The secondary air inlet 118 is positioned in this embodiment behind the battery 124 to ensure that the inlet 118 is in a dry area. The secondary air inlet 118 may be a vent located within the air tube 111 or snorkel 114. The secondary air inlet 118 may also be a separate air tube 121 appended to the air tube 111 or snorkel 114. Testing has determined that the sizes of the primary 116 and secondary 118 air inlets are dependent upon the height from the top 115*a* of the sump 115 to the level where water will begin to enter the air cleaner 110. As the height decreases, the area of the secondary air inlet 118 must increase. In this embodiment, the height is 190 mm. and the ratio of the areas of the primary air inlet 116 to the secondary air inlet 118 is 4.5 to 1.

During conditions when the vehicle is drive through a large puddle, water may be sucked into the engine air intake system through the primary air inlet 116. If the primary inlet 116 or sump 115 is temporarily locked or restricted, air will not be able to reach the air cleaner 110 by means of the air tube 111 or snorkel 114 without secondary air inlet 118. However, with secondary air inlet 118, sufficient air can be sucked from the secondary air inlet 118 to keep the vehicle from stalling. Within a few seconds, the water will be completely eliminated through the drain 117, and the air can again enter the air cleaner 110 from the primary air inlet 116. Once the air reaches the air cleaner 110 and is filtered, it will flow through the clean air duct 120 to the engine 22

I claim:

1. An engine air intake system comprising an air cleaner, a primary inlet tube with an opening that has access to fresh air, said inlet tube and said air cleaner defining a path for air flow to the engine, and a secondary inlet with an opening that has access to air, said primary and secondary inlet openings communicating air to said air flow path, said secondary inlet opening having a more restricted flow area than the primary inlet opening, said primary inlet opening being spaced from the secondary inlet opening and air cleaner, said primary inlet tube being formed to include a descending region and an ascending region and a sump in said air flow path between said regions, said sump having a drain at its low point, and said secondary inlet opening communications air to said air flow path at a location in said flow path which is downstream of said sump and at an elevation higher than said sump, wherein a greater amount of air flows through the primary inlet opening than through the secondary inlet opening when the sump is dry, and if water collects in the sump and completely blocks air access from said primary inlet opening to the air cleaner, the secondary inlet opening will provide adequate air for the engine air intake system until the drain can eliminate the water from the sump.

2. An engine air intake system comprising an air cleaner, and a snorkel, said snorkel having a primary inlet opening that has access to fresh air, and a secondary inlet opening that has access to air, said primary inlet opening and secondary inlet opening communicating air to the air cleaner through said snorkel, said secondary inlet opening having a more restricted flow area than the primary inlet opening, said snorkel has said primary inlet opening located at a height lower than the secondary inlet opening, so that said primary inlet opening forms a drain, wherein if water collects in the snorkel and reduces or blocks air access from said primary inlet opening to the air cleaner, the secondary inlet opening will provide adequate air for the engine air intake system until the primary inlet opening can drain and eliminate the water from the snorkel.

* * * * *